US005282179A

United States Patent [19]

Vuilleumier

[11] Patent Number: 5,282,179

[45] Date of Patent: Jan. 25, 1994

[54] CALENDAR MECHANISM FOR CHRONOGRAPH WATCH

[75] Inventor: Cyril Vuilleumier, Switzerland

[73] Assignee: Eta SA Fabriques d'Ebauches, Granges, Switzerland

[21] Appl. No.: 838,685

[22] Filed: Feb. 21, 1992

[30] Foreign Application Priority Data

Feb. 25, 1991 [CH] Switzerland ..... 00558/91

[51] Int. Cl.[5] ..... G04B 19/24

[52] U.S. Cl. ..... 368/28; 368/35; 368/37

[58] Field of Search ..... 368/28, 35, 37

[56] References Cited

U.S. PATENT DOCUMENTS

| | | | |
|---|---|---|---|
| 3,704,583 | 12/1972 | Dome | 368/37 |
| 3,939,645 | 2/1976 | Charbonney | 368/35 |
| 4,060,976 | 12/1977 | Jakob | 368/37 |
| 4,234,943 | 11/1980 | Teramoto et al. | 368/35 |
| 4,257,113 | 3/1981 | Meister et al. | 368/35 |
| 4,443,112 | 4/1984 | Stotz et al. | 368/37 |
| 4,611,925 | 9/1986 | Vuilleumier et al. | 368/28 |
| 4,671,670 | 6/1987 | Kroner | 368/37 |
| 4,676,659 | 6/1987 | Vuilleumier | 368/37 |
| 4,837,755 | 6/1989 | Besson | 368/35 |

FOREIGN PATENT DOCUMENTS

| | | |
|---|---|---|
| 0165455 | 7/1988 | European Pat. Off. . |
| 647125 | 1/1985 | Switzerland . |
| 660438 | 4/1987 | Switzerland . |

OTHER PUBLICATIONS

Illustrated Professional Dictionary of Horology. G. A. Berner, Jul., 1961.

*Primary Examiner*—Bernard Roskoski

*Attorney, Agent, or Firm*—Griffin Butler Whisenhunt & Kurtossy

[57] ABSTRACT

This chronograph-watch includes, superposed over one another and in the following order, a motor module (19), a chronograph module (27) and a dial (12). The motor module comprises a first date ring (17). The chronograph module includes a second date ring (28) located immediately under the dial and bearing indications (14) concerning the date which appear through an opening (13). The second ring (28) is controlled by the first ring (17), through a drive chain (32, 33, 34, 36) assembled in the chronograph module.

6 Claims, 5 Drawing Sheets

CALENDAR MECHANISM FOR CHRONOGRAPH WATCH

This invention concerns a date mechanism for a chronograph watch, said watch including a motor module, a chronograph module disposed over the motor module and linked with the motor module, and a dial and indicating elements disposed over the chronograph module, said motor module comprising a first date ring arranged so as to be stepwise driven once per day by means of a mechanism controlled by the motor element borne by the motor module, and a correction mechanism for manually correcting the position of said first ring.

BACKGROUND OF THE INVENTION

Patent document CH-B-647 125 has already described a chronograph watch made up from a motor module on which there is placed a chronograph module. In this timepiece, the motor module includes a date indicator which appears at the bottom of a well formed in the thickness of the chronograph module. Such arrangement is not favourable since it dims substantially the date indication and it is not the enlarging lens which is provided which will bring light to the bottom of the well, such lens limiting in addition the aperture angle within which the date may be read.

SUMMARY OF THE INVENTION

To overcome the cited disadvantages, this invention proposes a new date indicator located directly under the dial, such indicator being controlled by the standard indicator which is furnished with the motor module. To this end, the invention is characterized by the fact that the chronograph module includes a second date ring situated immediately under the dial and bearing indications concerning the date, such indications appearing through an opening provided in the dial, said second ring being controlled by said first ring through a drive chain assembled in said chronograph module.

The invention will now be described with the help of the drawings which give a practical example of the chronograph watch according to the invention.

DESCRIPTION OF THE PREFERRED EMBODIMENT

Figure 1:
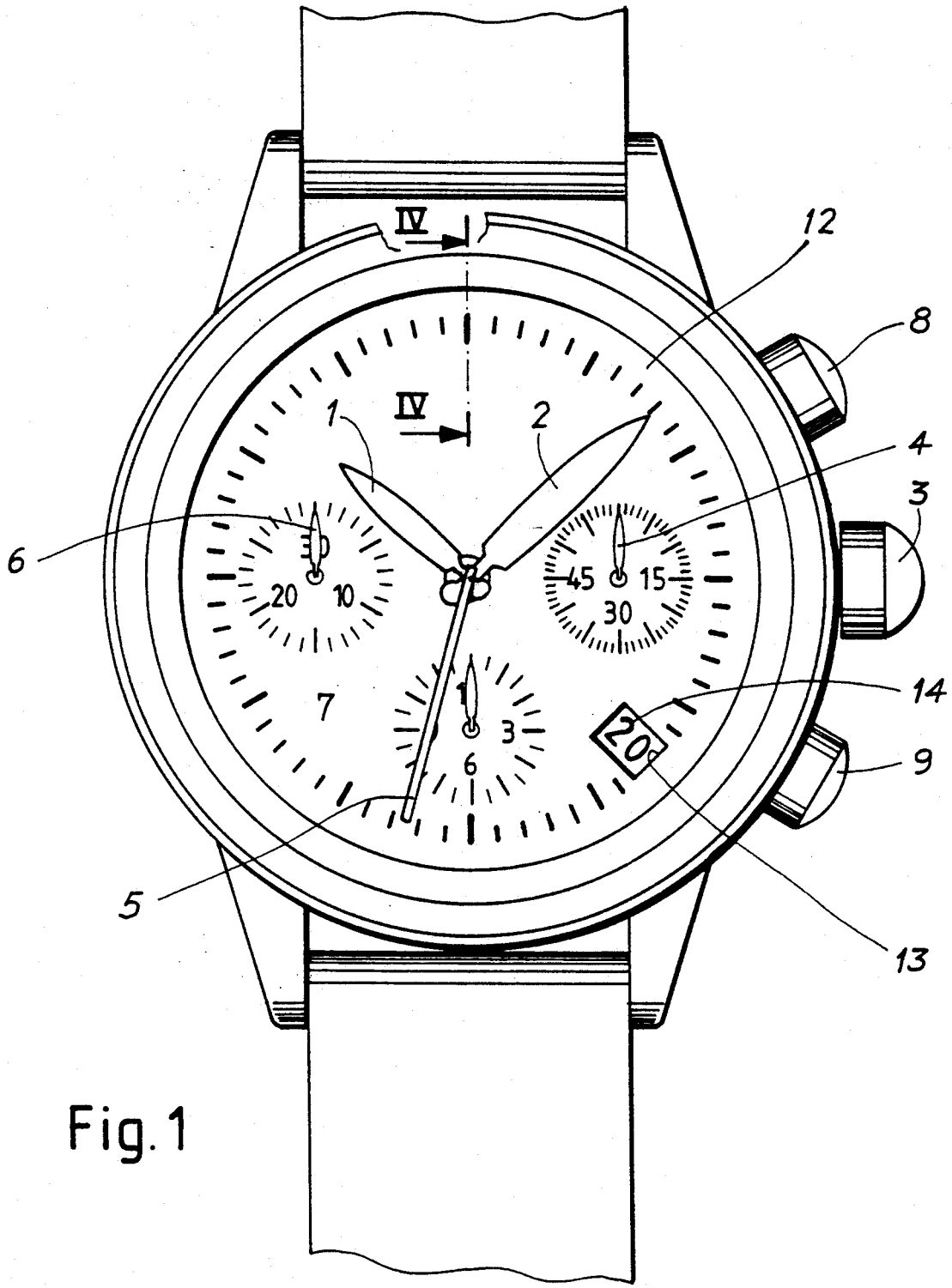
FIG. 1 is a view from above of the chronograph watch according to the invention.

A general view of the chronograph watch of the invention is shown on FIG. 1. The timekeeper of such watch shows hours hand 1 and minutes hand 2 which may be set by a crown 3. A small seconds hand 4 completes the timekeeper. As to the chronograph, this shows a central seconds hand 5, a minutes counter 6 and an hours counter 7, the starting and stopping of which are controlled by a push piece 8 and the reset to zero by a push piece 9. The hour indications appear on a dial 12 pierced with an opening 13 through which appears a date 14. Resetting the date is effected by crown 3. The present invention concerns exclusively the driving mechanism for the date 14.

The watch according to the invention includes a motor module, a chronograph module disposed over the motor module and linked with the motor module, and a dial and indicating elements disposed over the chronograph module. Such construction appears partially on FIG. 4 which is a cross-section along line IV—IV of FIG. 1.

Figure 2:
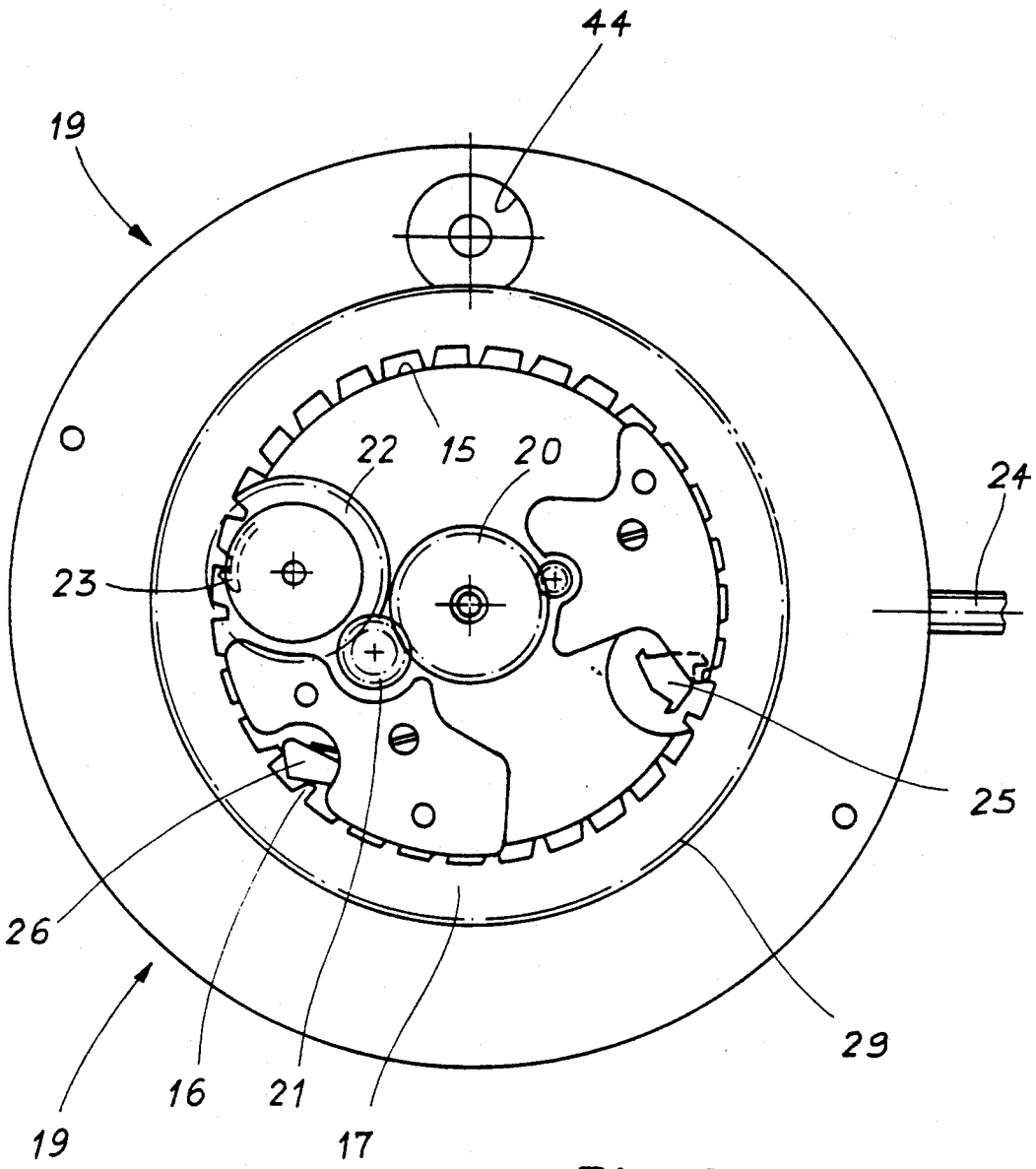
FIG. 2 is a view from above of the motor module, the chronograph module being removed, such view being along line II—II of FIG. 4.
Figure 4:
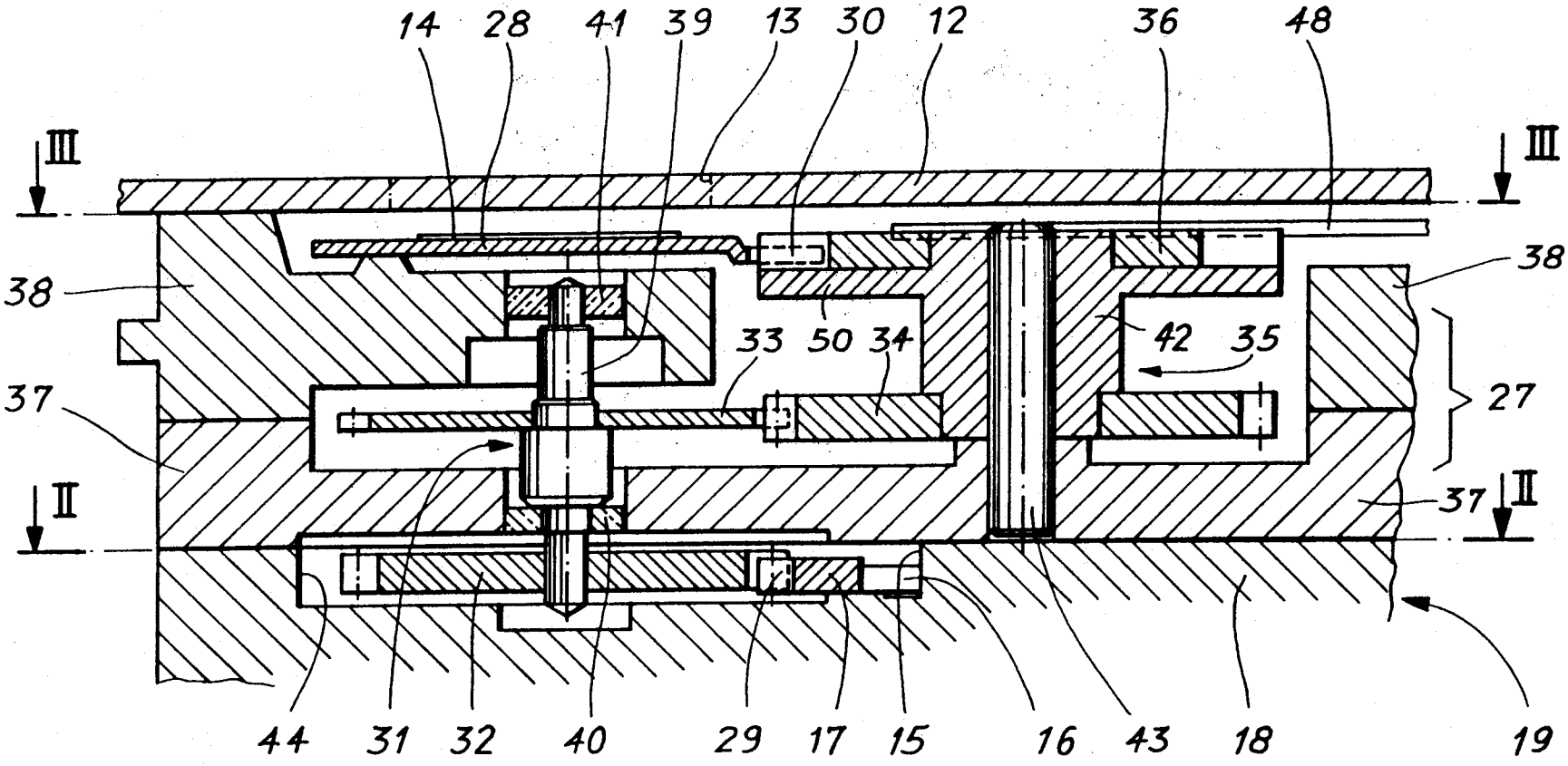
FIG. 4 is a cross-section through the chronograph watch along line IV—IV of FIG. 1.

In FIG. 4, the motor module 19 is shown only by a base plate 18 in which is provided a hollow 15 serving as a guide for the interior teeth 16 of a first date ring 17 which is assembled rotatively and coaxially to the center of the movement. As is apparent from FIG. 2, which is a view from above of the motor module along line II—II of FIG. 4, the date ring 17 is provided with interior toothing comprising thirty-one teeth 16, that is to say, one tooth per day of the month. The ring advances by steps, one each day at midnight. It receives its rotational movement through a gear train made up from the hours wheel 20 which makes one rotation in twelve hours, an intermediate date wheel 21 and a date wheel 22 which makes one rotation in twenty-four hours. A spring operating hook 23 coupled to wheel 22 causes ring 17 to advance through one step once each day when the hook 23 comes into mesh with a tooth of the ring. The hours wheel 20 is driven in a conventional manner by the motor element of the watch. The movement further comprises a mechanism for resetting the ring 17, such mechanism being controlled by stem 24 and of which there is seen only the part with three teeth 2 5 . Finally, a first jumper spring 26 enables to correctly position the ring 17 between steps.

FIG. 4 further shows a chronograph module 27 positioned on the motor module 19 and a dial 12 positioned on the chronograph module. According to the invention, the chronograph module 27 includes a second date ring 28 located immediately under dial 12, such second ring being controlled by the first ring 17 through a drive chain assembled in the chronograph module. A practical example of such drive chain will be explained hereinafter. The second ring 28 bears indications 14 concerning the date which appear through the opening symbolized by reference 13.

More precisely, the first ring bears interior teeth 16 serving for driving and correction thereof as has already been seen hereinabove and outer teeth 29 in mesh with a first end of the drive chain, the other end of such chain being in mesh with interior teeth 30 borne by the second ring 28.

Still more precisely and as appears to advantage on FIG. 4, the drive chain connecting rings 17 and 28 comprises a first wheel set 31 including two gears which are coaxial and fixed together, the first 32 meshing with the outer teeth 29 of the first ring 17, and the second 33 meshing with a first gear 34 of a second wheel set 35. Such second wheel set bears a second gear 36 fixed to the first gear 34 and which meshes with the interior teeth 30 of the second ring 28.

FIG. 4 shows that the chronograph module 27 assembled on the motor module 19 includes a chronograph plate 37 on which is fixed—by means which are not shown—a chronograph bridge 38. The first and second gears 32 and 33 of the first wheel set 31 are fixed to a shaft 39 which pivots in bearings 40 and 41 arranged respectively in the plate 37 and in the bridge 38. The first and second gears 34 and 36 of the second wheel set 35 are fixed to a hub 42 which pivots on a stem 43 fixed to the plate 37. Thus, the entire drive chain which drives the second date ring 28 forms a part of the chronograph module 27 including the first gear 32 of the first wheel set 31, such gear coming into place in a housing 44 provided in the base plate 18 of the motor module 19 when the motor and chronograph modules are assembled to one another. This housing 44 is also shown on FIG. 2.

As has already been said, the second date ring 28 is located immediately under dial 12 and the date indications 14 borne by the ring are visible through opening 13. It is noted that opening 13 is shown in dotted outline on FIG. 4, since it is located not to the right of wheel set 31, but at half-past four as is seen on FIG. 1, wheel set 31 itself being located at midday (FIG. 2 which shows housing 44 which receives gear 32 of wheel set 31). If one were to employ only the first ring 17 of the motor module 19 as date indicator and as has been suggested in the cited patent document CH-B-647 125, FIG. 4 shows the great distance which exists between such ring 17 and dial 12 of a nature such that the indications borne by the ring would appear in the shadow at the bottom of a well.

It is to be noted that it has already been suggested in the patent document EP-B-0 165 455 (U.S. Pat. No. 4,611,925) to diminish the width of the date ring and to add thereto outer teeth. However, in this document, the purpose is that of replacing the date ring by a hand and not to add to the first original date ring a second ring which would be close to the dial as is the case in the present invention.

Figure 3:
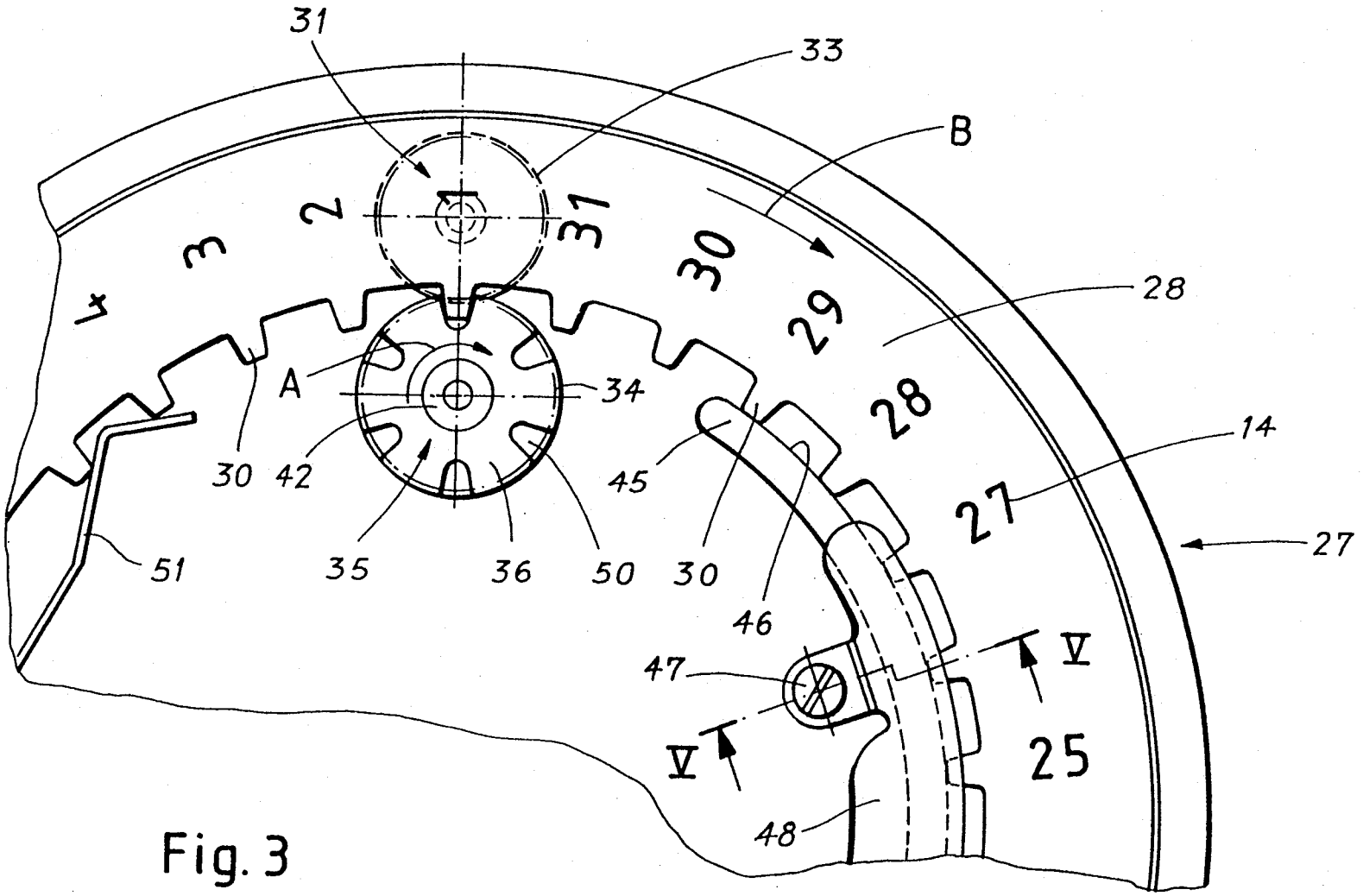
FIG. 3 is a partial view from above of the chronograph module, the dial being removed, such view being along line III—III of FIG. 4.

FIG. 3 is a partial view from above of the chronograph module according to line III—III of FIG. 4. In this view there will be recognized the second ring 28 with its date indications 14 and its interior teeth 30. There also appears on FIG. 3 the second gear 36 of the second wheel set 35, also called date driving star. When the star turns in the sense of arrow A, ring 28 advances in the sense of arrow B. Under star 36, there has been drawn in mixed outline the first gear 34 of the second wheel set 31.

The second date ring 28 is guided coaxially to the movement by an annular projection 45 showing a wall 46 against which the teeth 30 of ring 28 may bear. Means which limit the play of the ring in the sense of its height will be described now with the help of FIGS. 3, 4 and 5, FIG. 5 being a cross-section along line V—V of FIG. 3.

Figure 5:
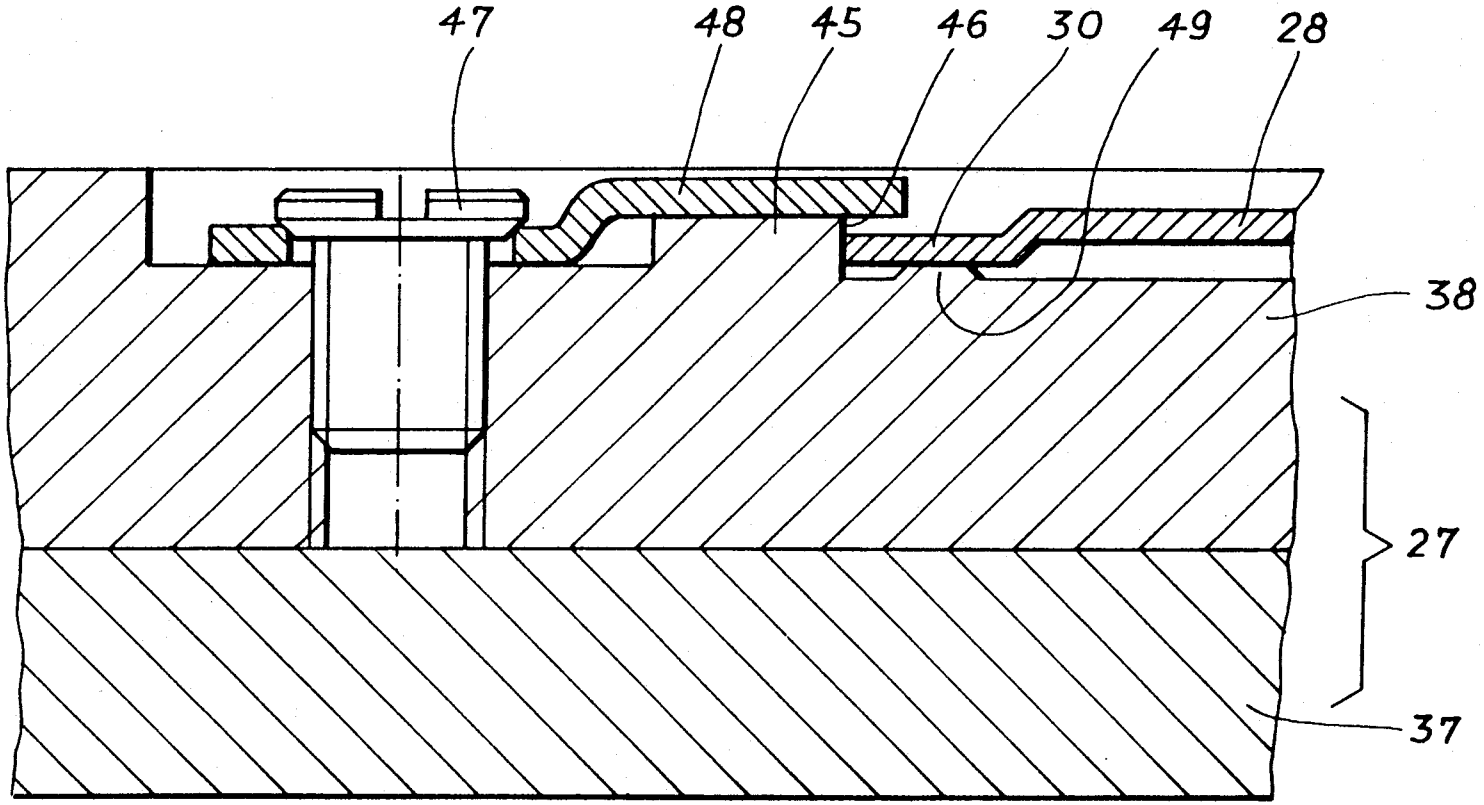
FIG. 5 is a cross-section along line V—V of FIG. 3.

As is apparent from FIGS. 3 and 5, on the chronograph bridge 38 there is secured by means of screw 47 a plate 48 of circular form extending over about 200° and engaging over the teeth 30 of ring 28. As is readily seen on FIG. 5, ring 28 is limited in its course in height by the retaining plate 48 against which teeth 30 may come into contact and which furthermore rest on a boss 49 formed on bridge 38. The ring is thus prevented from coming into contact with the dial.

The retaining plate likewise serves to limit indirectly the play in height of the second wheel set in order to prevent it from coming into contact with the dial. As may be seen on FIG. 4, a disc 50 is fixed to hub 42 and on such disc rests the second gear 36. Since ring 28 has a course limited in height, it will be the same for wheel set 35 and its hub 42 when disc 50 comes into contact with teeth 30 of ring 28.

It has already been mentioned that on the interior teeth 16 of the first date ring 17 there acts a first jumper spring 26. In the same manner, the second ring 28 will be indexed by means of a second jumper spring 51 as may be seen on FIG. 3. In this manner, the numbers indicating the date will be well centered in the opening provided in the dial.

It will be noted in conclusion that the mechanism of the invention enables correction of the date by the crown 3 forming a portion of the motor module. This avoids providing a corrector mechanism incorporated in the chronograph module which would in any case give rise to difficulties in accommodating it, the chronograph module being already overburdened with elements necessary for the chronograph function.

What is claimed is:

1. A calendar mechanism for a chronograph-watch, said watch including a motor module, a chronograph module disposed over and linked with the motor module, and a dial indicating elements disposed over said chronograph module, said motor module comprising, a first date ring arranged so as to be stepwise driven one step per day by means of a mechanism controlled by a motor element borne by the motor module and a correcting mechanism for manual correction of the position of said first ring, and the chronograph module including a second data ring located immediately under the dial and bearing indications concerning the date which indications appear through an opening formed in the dial, said second ring being controlled by the first ring through a drive chain assembled in said chronograph module.

2. A mechanism as set forth in claim 1 wherein said first ring bears interior teeth serving to drive it and correct it and exterior teeth meshing with a first end of the drive chain, the other end of said chain meshing with interior teeth borne by said second ring.

3. A mechanism as set forth in claim 2 wherein said drive chain includes first and second wheel sets each comprising two integrally formed coaxial gears, the first gear of the first wheel set meshing with the outer teeth of the first ring, the second gear of the first wheel set meshing with the first gear of the second wheel set and the second gear of the second wheel set meshing with the interior teeth of the second ring.

4. A mechanism as set forth in claim 3 wherein the chronograph module includes a plate and a bridge, the bridge being located under the dial, the first and second gears of the first wheel set being fixed to a shaft pivoted in the plate and in the bridge and the first and second gears of the second wheel set being fixed to a hub pivoting on a stem fixed to the plate.

5. A mechanism as set forth in claim 4 wherein the second gear of the second wheel set rests on a disc fixed to the hub, the diameter of the disc being substantially equal to the total diameter of the second gear and wherein a retaining plate partially covers over the interior teeth of the second ring so as to prevent said second ring and said second wheel set from touching the dial.

6. A mechanism as set forth in claim 2 wherein a first jumper spring cooperates with the interior teeth of the first ring and a second jumper spring cooperates with the interior teeth of the second ring, each of said jumper springs assuring indexation of the ring on which it acts.

* * * * *